US005934381A

United States Patent [19]

Larsen

[11] Patent Number: 5,934,381

[45] Date of Patent: Aug. 10, 1999

[54] HAZARD RESPONSE STRUCTURE

[76] Inventor: Theodore E. Larsen, 5800 St. Croix Ave., Minneapolis, Minn. 55422

[21] Appl. No.: 09/027,796

[22] Filed: Feb. 23, 1998

[51] Int. Cl.[6] ..... A62L 37/00

[52] U.S. Cl. ..... 169/60; 169/56; 169/61; 169/23

[58] Field of Search ..... 169/56, 60, 61, 169/23; 116/5

[56] References Cited

U.S. PATENT DOCUMENTS

| | | | |
|---|---|---|---|
| 4,022,131 | 5/1977 | Redding | 102/70.2 |
| 4,520,348 | 5/1985 | Swanson | 340/508 |
| 4,630,684 | 12/1986 | Conzori et al. | 169/46 |
| 4,719,973 | 1/1988 | Allen et al. | 169/61 |

*Primary Examiner*—Andres Kashnikow
*Assistant Examiner*—David Deal
*Attorney, Agent, or Firm*—James R. Cwayna

[57] ABSTRACT

A hazard response structure which includes a sensor mounting housing positioned over and against an aperture of an environmental enclosure to receive pressure from the enclosure and detonate a supply of suppression material to the enclosure upon an increase of pressure therein which is indicative of an impending explosion or fire. The housing is so shaped and the sensors thereof so located to eliminate the possibility of damage thereto or the accumulation of material thereabout to interfere with pressure transmission. At least three sensors are positioned in the housing and provided circuit logic requires a response from two of the three to initiate suppression material delivery to the enclosure. The sensors also provide for setting of operational thresholds without removal of the same from such housing. Safeguard circuitry, isolated from exterior circuitry, is provided which prevents discharge of the suppression control delivery when power is taken from or connected to the circuitry and which requires absolute voltage reversal to achieve triggering of the detonators of the suppression delivery system. This isolated circuitry also provides for monitoring wire continuity, relay status, switch status and capacitor status.

13 Claims, 6 Drawing Sheets

HAZARD RESPONSE STRUCTURE

RELATED APPLICATIONS

Applicant has no current applications on file which relate to the subject matter disclosed herein and is not aware of any applications by others which relate to the matter disclosed herein.

SPONSORSHIP

This application is the result of applicant's sole efforts and has not been made under any Federal or individual sponsorship.

FIELD OF THE INVENTION

This invention relates generally to structures and devices which are provided to monitor areas or processes which are susceptible to explosions or fires including rapidly growing fires which may ultimately lead to explosions with the monitoring devices acting to initiate material delivery suppression equipment in response to such a developing situation or to control the operation of process equipment, and more specifically to such a structure which incorporates at least three pressure monitoring stations with the requirement that two of the three stations must sense the development of such an explosion through pressure increase detection and to initiate suppression action in response thereto. The structure or device also includes an isolated, safeguard circuit which prevents actuation of the suppression equipment during connection to or disconnection from a power source and which requires complete voltage reversal for actuation of such equipment.

SHORT SUMMARY OF THE INVENTION

A hazard response structure specifically designed with a housing in pressure communication relation with the area or processing equipment requiring protection so as to detect pressure rises which may occur therein and activate suppression equipment or control such process equipment upon a pressure rise which is indicative of an impending explosion.

At least three pressure detection stations are arranged in such housing and are particularly positioned with respect to each other. Each of the detection stations includes a diaphragm having one side thereof exposed to or referenced to the monitored enclosure with the other side being exposed to atmospheric pressure. A switch combination is provided on the atmospheric side of the diaphragm and when the diaphragm is moved a sufficient amount due to an increase in pressure within the monitored enclosure, the switch will change state to an active or inactive condition dependent upon the particular sensing and control circuit operation.

By providing a set of three such switches and proper logic connection thereto, the system will not initiate suppression material delivery unless two of the three sensors or monitors indicate a pressure rise of predetermined magnitude within the monitored area.

Similarly, certain processes such as dust collectors, may operate under a lower than atmospheric pressure. The sequence of operation begins at atmospheric pressure, drops below atmospheric pressure and returns to atmospheric pressure when the operation is complete. By informing the logic circuitry that such a process is being performed and that the diaphragms and associated switches are in standby mode, should they, experience a return of pressure toward atmospheric pressure due to an impending explosion or actual explosion, the system will respond to the absolute increase in pressure rather than waiting for the pressure to rise above atmospheric pressure.

The design also provides for the actuation threshold of all system pressure sensors to be tested on side without removing the same from their mounted position.

The system also provides safeguard, isolated circuitry which prevents actuation of the suppression material during connect or disconnect from the primary power source by requiring an absolute positive voltage reversal for material suppression delivery operation.

BACKGROUND AND OBJECTS OF THE INVENTION

Many industrial and commercial processes involve the generation of combustible dust ranging from grain elevators to various types of dust collectors. Particle sizes smaller than 100 microns will tend to float in air, and when concentrations of these particles, beyond certain minimum amounts, are suspended in air, the environment in which the mixture exists needs only a source of ignition to produce an explosion.

Means have been developed to reduce the destructive force of explosions through venting but this is feasible only when the process equipment is located out of doors or close to exterior walls or ceilings, through which release of flaming materials would have no adverse consequences.

Explosion suppression techniques have also been developed which overcome some of the shortcomings of venting systems. As with all safety systems, however, one of the most important elements of an explosion suppression system is a reliable means of detecting a developing hazard. Among the options for such detection are optical detectors, heat sensors and pressure responsive devices. Optical devices tend to become obscured by dusty environments and heat sensors are generally too slow for use with rapidly developing fires. For hazards involving dusts, the most practical method of detecting a developing explosion is through the use of pressure sensors.

Pressure sensors generally employ a flexible diaphragm to convert pressure changes into mechanical or electrical output that can be used for a variety of purposes ranging from process equipment control to actuation of explosion suppression apparatus. To survive in a process environment and maintain response characteristics, it is necessary not only for the sensor mechanism itself to remain functional, but also for the sensor diaphragm to maintain its ability to sense pressure changes. Finally, the pressure passages between the sensor diaphragm and the process environment must be sufficiently clear to transmit pressure changes.

Because explosions involving dust/air mixtures develop rapidly and can become very destructive if not arrested at an early stage, the actuation threshold for pressure sensor must be quite small, for example 0.3 psig. This threshold must be maintained throughout the life of the system. Commonly employed technology requires the sensors to be periodically removed from their point of application for threshold measurement and adjustment. This is an expensive, cumbersome procedure and requires availability of spare sensors or requires system shutdown or resulting periods of no protection.

In addition to the problem of assuring accuracy of pressure actuation thresholds, many filter processes operate at negative pressures that vary as dust builds up on filters or due to the process itself, such as grain transfer from an enclosure.

There is clearly a need, not only for means of verifying and maintaining the threshold setting of pressure sensors, but also of compensation for negative process pressures that would prevent timely actuation of such pressure sensors i.e. actuation during fire-ball generation. Further, this verification and compensation must be applied in such a way that false actuation of the system is minimized or eliminated.

It is well known in the prior art to arrange a pair of sensing devices so that both must indicate the presence of a hazard before actuation of a safety system. The object of such an arrangement is to reduce the likelihood that false response of one sensor will cause false actuation of the safety system.

While such an arrangement can reduce the incidence of false actuation, it has the disadvantage that failure of one sensor is automatically a failure of both. The advent of solid state logic devices has made it practical to connect sensors into "voting" arrangements. Using three sensors, it is possible to require response from any two sensors for safety system actuation.

It is therefore an object of the Applicant's invention to provide a hazard response structure which will eliminate false discharge of suppression material by requiring multiple response to hazard existence.

It is a further object of the Applicant's invention to provide a means for measuring the actuation threshold of pressure sensors and for adjusting the same without removal of the sensors from their sensing stations.

It is a further object of the Applicant's invention to provide for continuous and automatic monitoring of pressure sensor circuits by employing normally closed switch contacts and to provide the same in a protective housing so as to avoid accidental shorting of the circuits.

It is still a further object of the Applicant's invention to provide a pressure sensor system including at least three sensor units with a control logic circuit that requires response from any two of the sensors before initiation of a suppression system.

It is still a further object of the Applicant's invention to provide a safeguard circuit for a pressure response, suppression material actuation or delivery system which includes an isolated, voltage detection means which will prevent actuation of the suppression system during connecting or disconnection of the system to and from a power source due to power line failure or interruption by personnel for system maintenance, and which will require absolute voltage reversal of the system to achieve suppression system actuation.

These and other objects and advantages of the Applicant's invention will more fully appear from a consideration of the accompanying drawings and disclosure.

SHORT DESCRIPTION OF THE DRAWINGS

Figure 10:
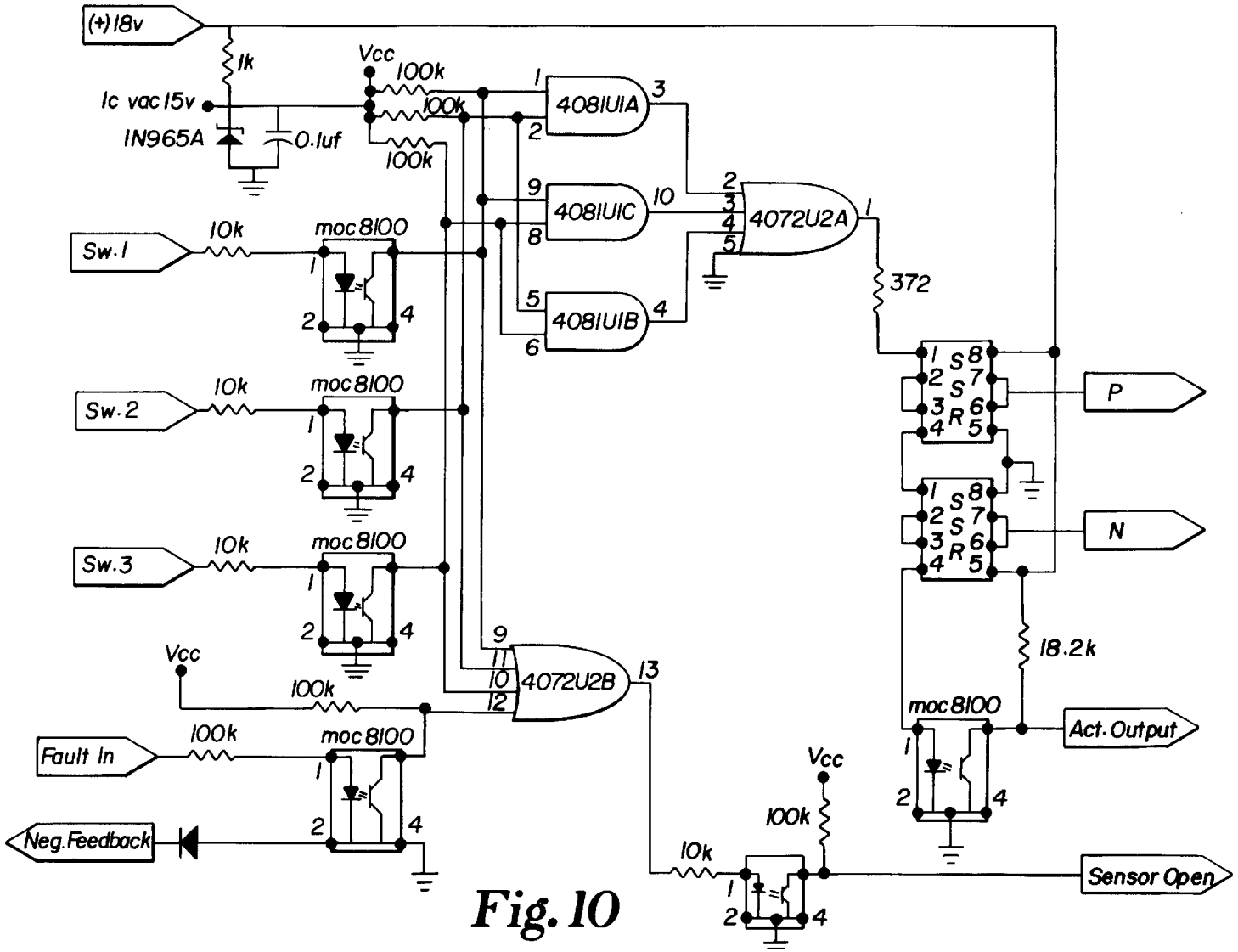
Figure 11:
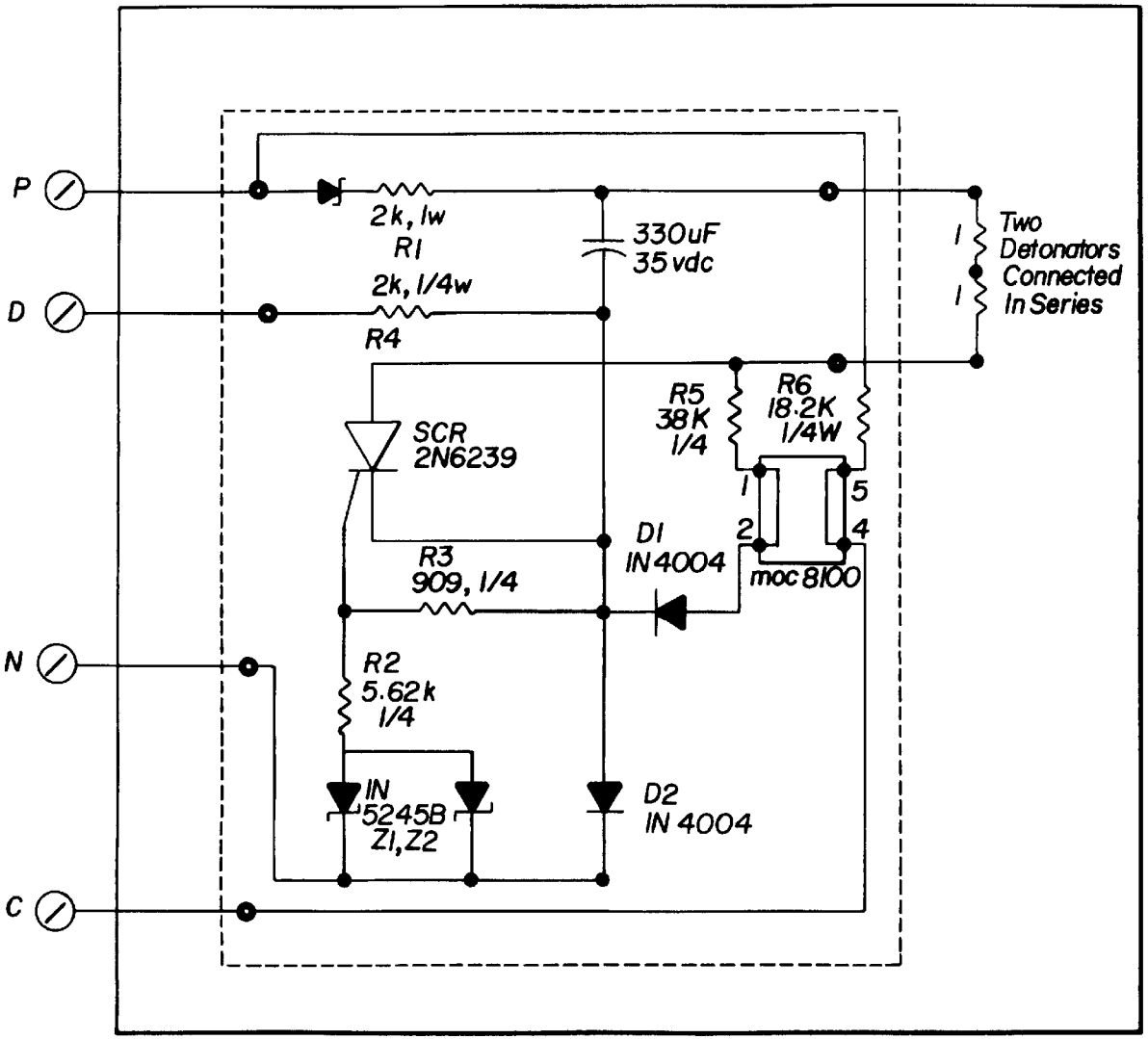

FIG. 10 is a circuit schematic which illustrates the electrical/electronic connections to the sensor switches to achieve the 2-out-of-3 logical control features of the invention; and, FIG. 11 is a circuit schematic particularly illustrating the safeguard circuitry to provide a break-before-make control for the circuit of FIG. 10 to prevent detonation of the suppression material distribution system unless there is an absolute voltage reversal in the system rather than the circuitry simply reading a zero voltage as may occur when connecting or disconnecting the circuit to or from a source of power.

DESCRIPTION OF A PREFERRED FORM OF THE INVENTION

In accordance with the accompanying drawings, the sensor mounting structure, including sensors, is generally designated 10. Mounting structure 10 includes a first mounting plate 11 and a sensor mounting sections 11*a* upon which sensors 13, 14, 15 are mounted. As illustrated, the sensor mounting section 11*a* includes vertical side plates 16, 17, a connective plate 18 perpendicular to first mounting plate 11 and two section frontal portion 19, 20 with the first portion 19 being at a first angle with regard to mounting plate 11 and the second portion 20 being arranged from the end of portion 19 and extending to plate 18. The angular positioning of the two section frontal portions 19, 20 is important to protect against dust or particle accumulation within the sensor mounting section 11*a*. The arrangement of the sensors 13, 14, 15 on the upper portions of side plates and on angularly arranged second frontal section 20, all positioned with respect to opening A in the wall W of a protected or monitored enclosure (such enclosure not being shown but being of any shape and defined by walls W) prevents material movement from the enclosure into the sensor mounting section 11*a* and therefore possible movement of material from the enclosure against the operative portions of the sensors 13, 14, 15 when the structure 10 is attached to any vertical side wall W of an enclosure.

The positioning of sensors is also at angular relation to one another to reduce the probability of sensor actuation due to a directional impact of any type against the enclosure 11*a*.

The angularity of the various surfaces, particularly surface 19 to mounting plate 11 will prevent accumulation of particulate material that is normally contained within an enclosure. Preferably, plate 19 is at an angle of 30 degrees which would make angularity of plate 20, mounting for sensor 14, less than vertical and similarly, sensors 13, 15 are mounted on vertical surfaces which will not accumulate material whether the unit 10 is mounted in a vertical or horizontal position.

Figure 4:
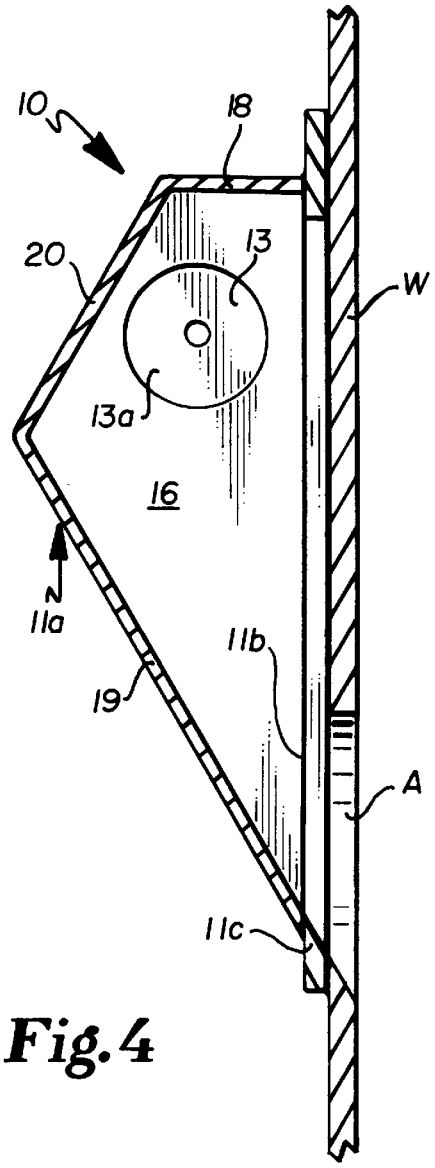
FIG. 4 is a vertical section taken substantially along Line 4—4 of FIG. 2.

As illustrated in FIG. 4, and aperture A is provided through enclosure wall W for the transmission of pressure from the enclosure to the sensor housing 11 and mounted sensors 13, 14, 15.

Figure 3:
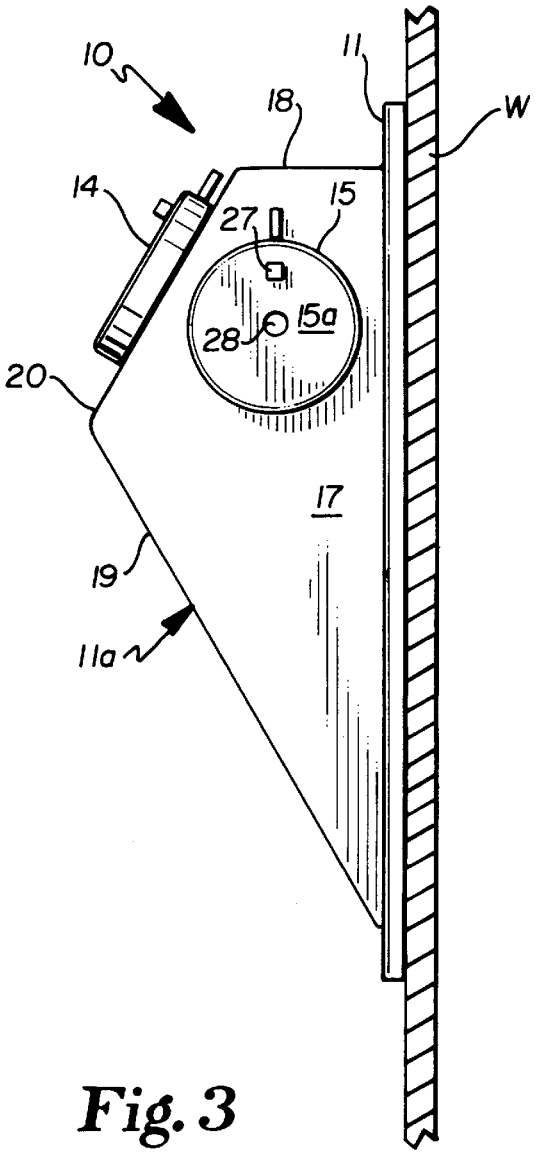
FIG. 3 is a side view of the sensor mounting housing.

FIG. 4 is a vertical cross section taken along Line 4—4 of FIG. 3 and illustrates the relation of open 11*b* in mounting plate 11 to allow communication with the interior of the enclosure E for pressure communication to the interior the sensor housing 11*a*. It should be noted that the size of opening A is large and is provided with an angular lower end section such that, if the unit is vertically positioned, no material collective lower edge is presented to thus eliminate particulate accumulation to block pressure communication between the enclosure and the housing 10.

In FIG. 4, sensor 13 is illustrated on wall 16 and the flexible diaphragm 13 *a* thereof is exposed to the interior of housing 11*a*.

Obviously, in the various views, fastening means to mount plate 11 and sensor mounting housing 11*a* to the enclosure wall W are not illustrated but, it should be obvious to anyone skilled in the art, that unit 10 must be sealingly mounted to wall W and FIG. 4 does illustrate a sealing member 11*c* between plate 11 and wall W.

Figure 2:
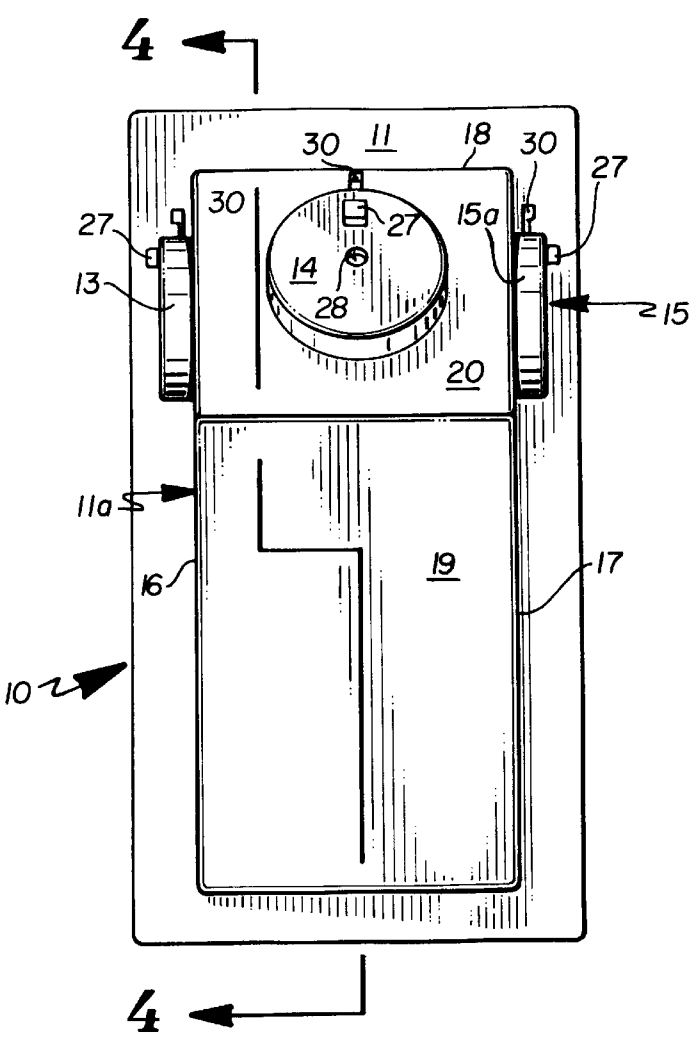
FIG. 2 is a front view of the sensor mounting housing.
Figure 1:
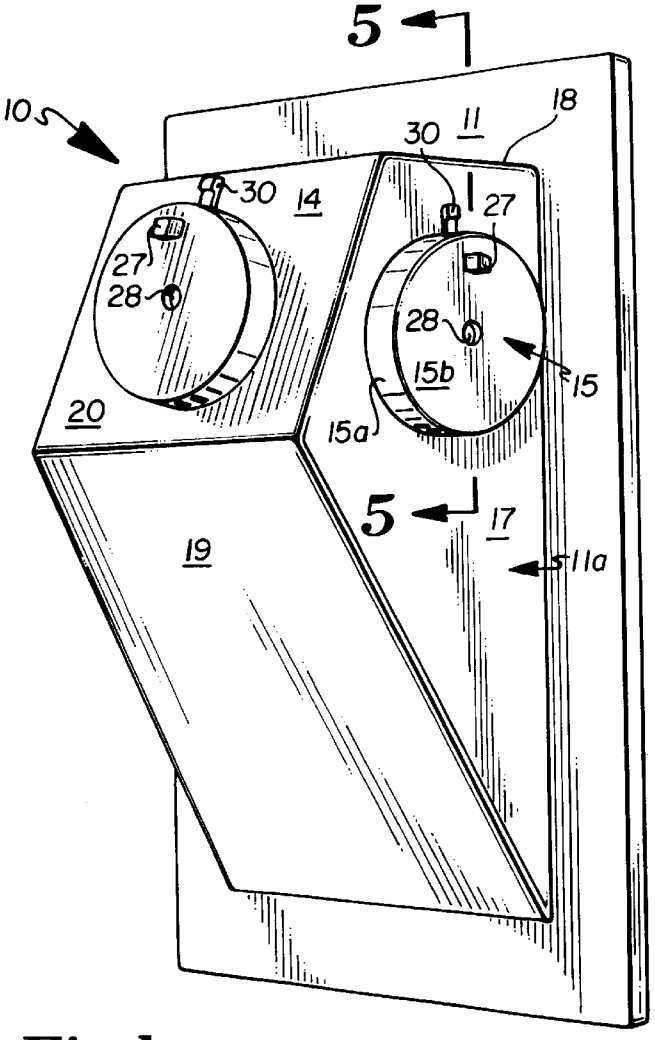
FIG. 1 is a perspective view of a sensor mounting housing embodying the concepts of the Applicant's invention and illustrating sensors mounted thereon.
Figure 5:
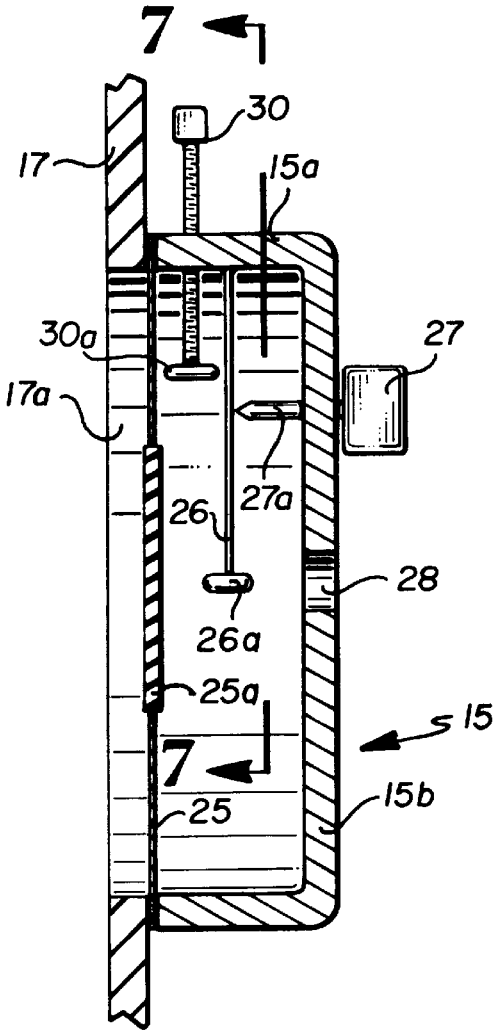
FIG. 5 is a vertical section taken substantially along Line 5—5 of FIG. 1.
Figure 7:
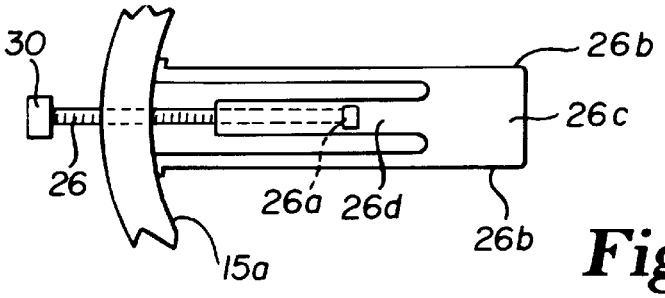
FIG. 7 is a vertical section taken substantially along Line 7—7 of FIG. 5.

FIG. 5 is represented view of any of a first form of an individual sensor unit and this view is taken substantially along Line 5—5 of FIG. 1 in which sensor 15 is mounted on wall 17 of sensor housing 11*a*. As illustrated, an aperture 17*a* is provided through wall 17 and a flexible diaphragm 25 spans aperture 17*a* and is held in position by shoulder portions 15*a* of the switch housing 15 which also includes a top surface or cover 15*b*. Diaphragm 25 may be provided with a plate 25*a* over the central portion thereof. A spring/lever arrangement 26, as further illustrated in FIG. 7, is secured to shoulder 15*a* and extends inwardly therefrom to have its endmost, enlarged, portion 26*a* positioned to be moved and activated by diaphragm plate 25*a* upon an increase in pressure within the process area. Switch 27 is provided on top or cover 15*b* of the housing 15 and is sealed thereto. An actuating end 27*a* of switch 27 extends into the interior of housing 15 to be in close association to spring/lever 26*a* for actuation thereby.

Means for adjusting the actuation point of the spring/lever 26 includes a threaded adjustment member 30 which is threadedly inserted through housing shoulder 15 and has the end 30*a* thereof in close contact with spring/lever 26. As illustrated in FIG. 7, the spring/lever 26 is of a tri-part structure which incorporates a pair of arms 26*b* extending from and connected to housing shoulder 14*a* to a common end 26*c* with a free arm element 26*d* therebetween against which end 26*a* of adjustment member 26 will abut. Simply moving end 26*a* of the adjustment unit 26/30 will change the fulcrum location of the spring/lever 26 which will increase or decrease the force required to actuate switch 27, said force being a result of pressure within the enclosure exerted on the diaphragm 25.

Figure 6:
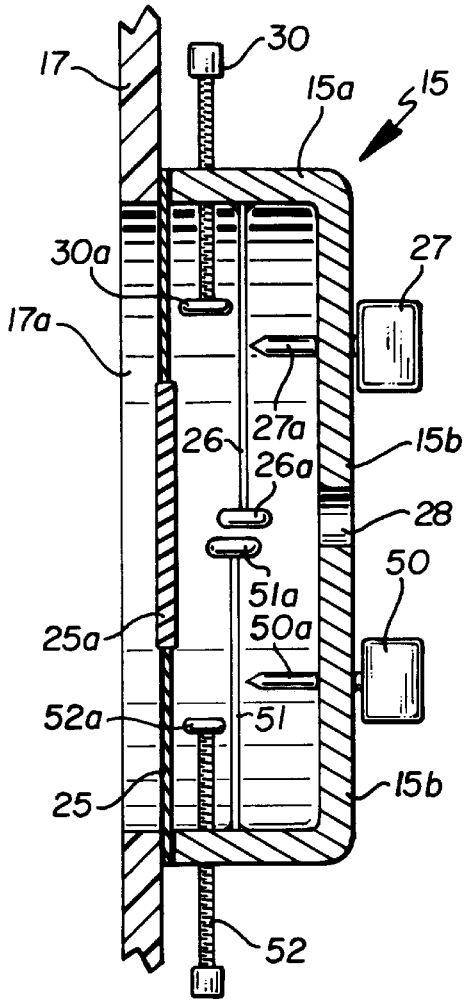
FIG. 6 is a modified section similar to FIG. 5 which incorporates dual switch units.

A modified form of sensor arrangement is illustrated in FIG. 6. As illustrated therein, the sensor unit includes the structure of FIGS. 5 and 7 and another set of switch, spring lever adjustment means. In this form, the switch is designated 50, the spring/lever combination 51, enlarged spring/lever end 51*a* and the threaded adjustment member and end being designated 52, 52*a*. With this structure, it should be obvious that two pressure responsive levels may be determined and adjustment made for each.

An aperture 28 is formed through the center portion of top or cover 15*b* of housing 15 to allow communication to atmosphere such that one side of diaphragm 25 is exposed to monitored enclosure E pressure and the other side is exposed to atmospheric pressure.

As stated, certain processes such as dust collecting, have an enclosure which operates at a negative pressure. In such a situation, the pressure before the process begins is at atmospheric and then drops to some negative value during the process operation and returns to atmospheric upon process shutdown.

Figure 9:
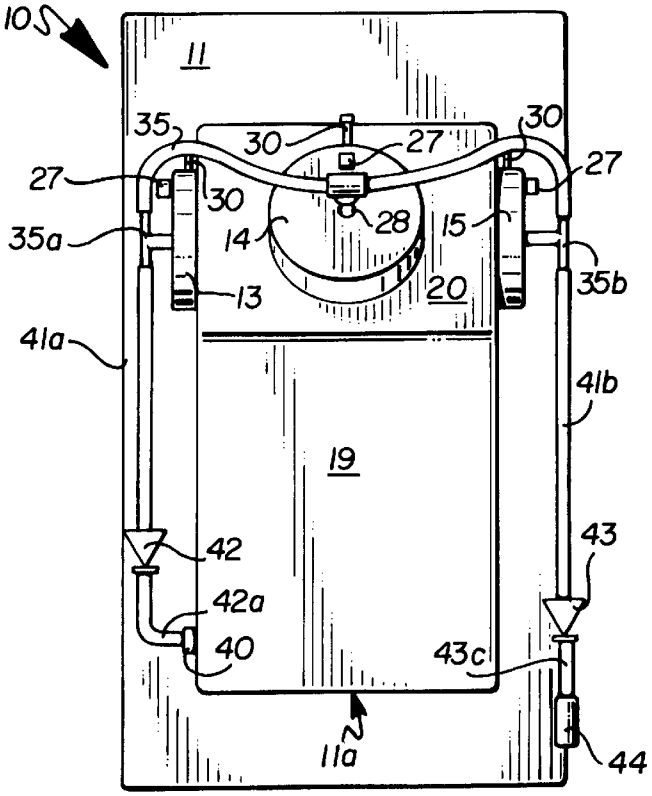
FIG. 9 is a view of a modification of FIG. 8 wherein the testing system is provided with balance check valves to achieve negative process pressure compensation and threshold settings.

Through the pneumatic connections illustrated in FIG. 9, the sensors are referenced to the pressure on both sides of diaphragms 25. If, at any time during operation of the process, the pressure moves to a positive pressure, an impending dangerous condition is indicated.

When this occurs, check valve 42 of FIG. 9 will be forced closed, leaving the opposite or back sides of diaphragms 25 exposed to the process pressure that existed prior to the positive pressure increase. Check valve 43 of FIG. 9 insures that no positive pressure can build up on the back side of diaphragms 25 due to their outward displacement under action of pressure rising within the enclosure. Thus, if this pressure increase exceeds the previously adjusted actuation setting of the individual sensors and if at least 2 of the 3 sensors experience this increase, the suppression system will be activated through switch 27 and the logic circuitry of FIG. 10.

FIG. 10 is a circuit schematic which illustrates the electrical/electronic connections of the sensor switches stemming from sensors 13, 14, 15 (which are respectively designated Sw1, Sw2 and Sw3) in the development of the 2-out-of-3 voting logic.

Whereas state of the art pressure sensors typically use electrical contacts that are open in the standby mode and close in response to a pressure increase, a unique characteristic of applicant's invention is that the switch contacts of sensor 13, 14, 15 are held in normally closed position during standby, and the system actuation is initiated when 2 or more of the switch contacts are opened. This arrangement allows the switch contacts to be electrically monitored during the typically long periods of standby service which significantly increases the reliability of the system by allowing for continuous and automatic monitoring of vital sensor circuits. Open switches during standby would not allow for circuit analysis.

The actuation command from the electronic/electric circuitry is not subject to interference from a simulation by spurious signals which may arise due to inductive or capacitive coupling between output wiring and other non-system circuits. When at least 2 of the switches Sw1, SW2, Sw3 satisfy the logic of AND gate U1, one or more of gate output pins 3, 4, 10 change state and cause OR gate U2 to energize relays K1 and K2. This reverses the polarity of the output terminals P and N, which causes discharge of remote SCRs that release energy for system actuation. Because the system does not rely on an increasing or decreasing signal to produce system actuation, but rather the change in circuit polarity, the level of current flow in the output wiring can be limited to intrinsically safe levels at all times.

The sensor electrical/electronic circuitry provides this automatic monitoring of vital sensor circuits, but its primary purpose is to interpret input from the sensors and to initiate material suppression system actuation or process equipment shut down when the logic circuitry indicates the existence of developing explosion hazard.

Although the use of closed contacts during standby of the system has the major advantages described above, there is one potentially critical problem which must be avoided. Because the switch contacts are closed, the monitors cannot identify a short circuit condition that could result from wear or other physical damage to sensor switch wiring. This problem is effectively overcome in applicant's design by bringing all sensor switch wiring into one protective enclosure. In the unlikely event that such a shorting condition should occur despite the protective environment, it would be detected during normal periodic maintenance procedures as described hereinafter. The circuit logic is such that wires entering or exiting the enclosure are capable of being monitored for short circuit condition and only wiring within the enclosure is a risk.

Figure 8:
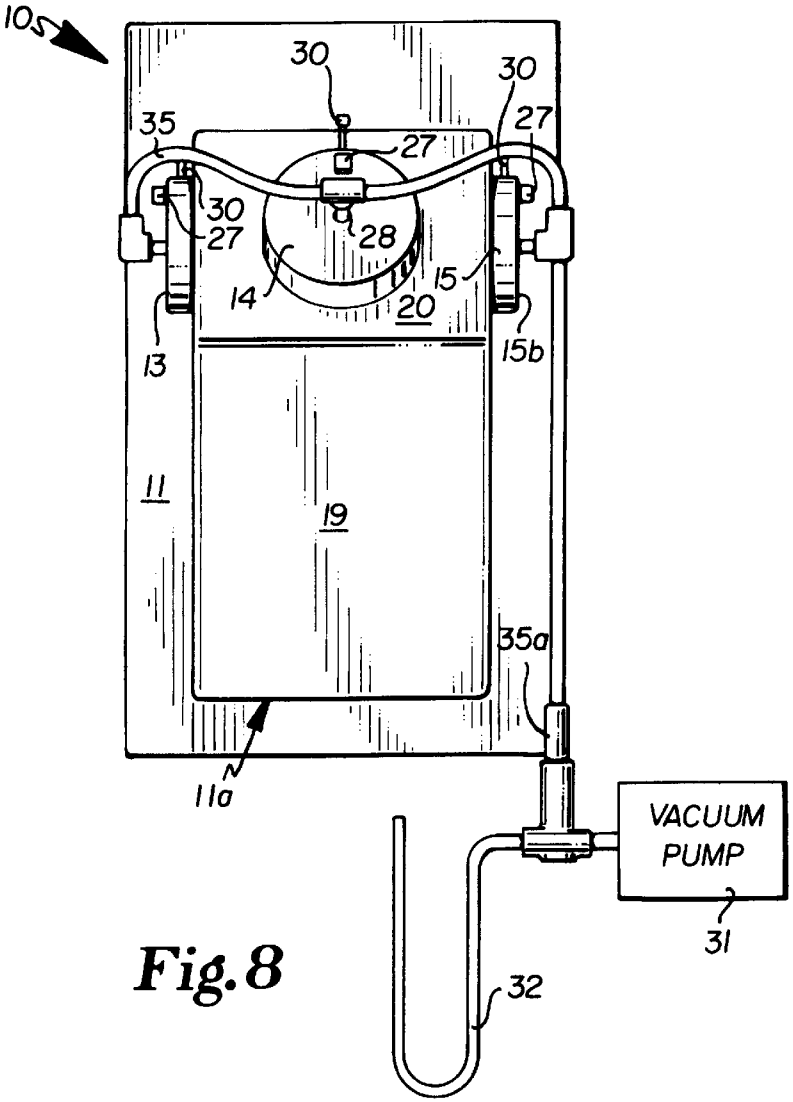
FIG. 8 is a view illustrating the applicant's structure which enables the actuation threshold of all system pressure sensors to be tested on site and reset or adjusted as required without removal of the sensor mounting housing from the area of protection.

FIG. 8 illustrates that arrangement to test for and set the actuation threshold of all sensors and for on site testing without removal of the sensors from their mounted positions. Whereas this arrangement is primarily for periodic monitoring of threshold adjustment, it will also identify any sensor shorted-lead condition.

It is understood that each sensor 13, 14, 15 is exposed to the pressure of the process environment on one side of the diaphragms 25 and to atmospheric pressure on the other side thereof. By adding tube 35 to connect the atmospheric sides of each sensor and utilizing a vacuum pump 31 and a manometer 32 at the end of such tube 35, it is possible to induce actuation of the detectors by drawing a vacuum on the back side of diaphragms 25.

For purposes of illustration, assume that the pressure on the enclusre E side of the diaphragms 25 is at atmospheric pressure and a negative pressure is generated in the closed and connected environment through the vacuum pump 31. The magnitude of this negative pressure can be measured through manometer 32 and the sensors 13, 14, 15 will be acted upon by the pressure within the process enclosure. Drawing a vacuum on one side of the sensor membranes 25 is equivalent to exerting a positive pressure on the other or enclosure side. Thus the negative pressure at which the system operates under action of vacuum pump 31 is equal to the positive pressure that would actuate the sensors 13, 14, 15. Thus, an effective means of measuring pressure sensor threshold is provided by this method of applying a vacuum to the closed environment created by linking the pressure sensor housings through tubing 35. The total system actuation point can thus be accurately and directly determined through response of the electronic circuitry described shown in FIG. 10.

In the event that any of the sensor switch circuits are shorted, this fact will be revealed by failure of the affected sensor to indicate a response to the applied vacuum. It should be particularly noted that all of the circuitry of FIG. 10 with the exception of the switch connections, illustrated as Sw1, Sw2 and Sw3 is located within a protective housing or environment.

Operative threshold setting is now adjusted by varying the fulcrum of spring/lever 26 through moving the adjustment member 30. The operative threshold setting obviously refers to the pressure accumulation in the enclosure and the sensor housing 11 acting against the sensor diaphragms 25, at which pressure the sensor logic will initiate the delivery of suppression material.

It is often the case, however, that industrial processes, which include dusts are designed to transport product from one part of the process to another under the action of vacuum pumps. Thus the process enclosure itself begins at atmospheric pressure at start-up and returns to atmospheric pressure when shut down but is at negative pressure during normal process operation. State of the art apparatus provides for some degree of compensation for this negative pressure situation by providing a separate reference chamber between the process and the sensor housing. Typically this reference chamber has a "bleed" hole leading to atmosphere, an arrangement having the major disadvantage that plugging the "bleed" hold will change the actuation point of the sensor. Since air is being drawn into the bleed hole, it is normal to expect that foreign material will gradually accumulate in this hole and adversely affect the sensor threshold accuracy.

Applicant's design for such negative pressure situations includes a system of balanced check valves connecting into the tubing arrangement of FIG. 8 and as illustrated in FIG. 9. T-fittings 35*b* replace the fittings of FIG. 8 in sensors 13, 15 and give access to line 35 connecting sensors 13, 14, 15. Connective tubing 41*a*, 41*b* extend from these Ts 35*b* to check valves 42, 43 with check valve 42 connected through fitting 42*a* to sensor housing 11*a* through fitting 40 and check valve 43 is unidirectionally vented to atmosphere through tubing 43*c*. During operation of the process, any negative pressure within the process environment will be drawn also on the closed environment provided by tubing 35 and the connections to the sensors 13, 14, 15. However, in the event of a sudden increase in pressure within the process enclosure, check valve 42 will lose and a pressure will be established across the sensor diaphragms 25 with resulting actuation of the sensors. The second check valve 43 is now connected to the other end of tube 35 and is arranged so that any pressure build-up on the switch side of the sensors, due to outward movement of the diaphragms 25 will be vented to atmosphere. This is all accomplished without drawing air from atmosphere and thus the shortcomings of the "bleed" hold arrangement are not present. Further, it is possible to draw a test vacuum on the sensor 13, 14, 15 in the same manner as described for FIG. 7. Any vacuum applied at end 44 of the tubing will open check valve 43 and close check valve 42, isolating the switch side of the sensor diaphragms 25. Whatever the pressure within the process enclosure, the level of vacuum applied to the back of the sensors will accurately reference the sensors for response to an increase in pressure on the enclosure side of the membranes that would cause actuation of the logic controlled suppression system.

Aspects of particular interest with regard to the invention include continuous and automatic monitoring of pressure sensor circuits by employing normally-closed switch contacts, and to protect these circuits from their only mode of failure, shorted leads, through assembly in a unitized manner and being enclosed in a protective housing. Therefore, only switch wiring within the protective housing could be adversely affected by shorting and these wires are electrically and mechanically protected. Further protection is afforded by the use of redundant detectors which are connected so that any 2 of the 3 sensors will produce a suppression system actuation and yet are further provided with means for interrogating switch wiring during routine vacuum tests of the pressure sensor actuation threshold.

Protection from false system actuation due to capacitance or inductive coupling of system wiring with non-system circuits, and limitation of output circuit current to intrinsically safe levels are both achieved by virtue of the voltage reversal actuation command from the sensor electronics.

A further improvement to the basic device is provided in the circuitry of FIG. 11. This circuit is basically a departure, through addition to a basic circuit known in the art by which had not been obvious to those skilled in the art.

The SCRs arranged in the detonator module are triggered by Zener diodes which are connected to their gate circuit, such that with negative potential on the gate, the SCR is biased OFF. When a positive voltage, resulting from the voltage reversal, is greater than the break-down voltage of the Zener diodes is imposed on the normally negative terminal of the detonator module, the bias on the SCRs is changed to the ON mode. However, voltage transients resulting from interruption of the supply for example, power connect and disconnect or turning the system on and off for maintenance, will also cause firing of the SCR. To limit or prevent such an undesirable situation an ordinary diode was positioned in the positive side of the line but since the detonator module must be capable of functioning regardless of voltage polarity, such diode had to be located upstream of the voltage reversal circuitry and this resulted in only a temporary solution.

Various circuit modifications were attempted which finally resulted in a circuit which is intrinsically safe and which is illustrated.

The addition of a Zener of proper voltage rating with regard to the positive input of the detonator module basically provides greater protection to the capacitor of the module to prevent it from discharging out to the connective wiring and negating the intrinsical safety of the system. This also prevents triggering of the SCRs unless there is an absolute voltage reversal which reversal is at least equal to the breakdown voltage of the Zener in the positive leg. With the Zener characteristics, it is placed in series with the positive terminal of the detonator module which is downstream of the voltage reversal circuit and in this position terminal of the detonator module which is downstream of the voltage reversal circuit and in the position, it will conduct as an ordinary diode when positive power is applied to the normally positive terminal of the detonator module. Upon absolute voltage reversal it will, however, block conduction of the SCRs until the voltage exceeds a predetermined breakdown level in the reverse direction.

In the FIGS. 10 and 11 the improvements over the prior art consist of the addition of the detonator bridge monitoring circuitry, while maintaining intrinsic safety; addition of the positive-circuit Zener to prevent detonator actuation without absolute and true voltage reversal and the provision of a monitored break-before-make switching. The prior art illustrates a DPDT switching arrangement but makes no suggestion on how to effect the same for break-before-make operation.

As illustrated in FIG. 11, the primary circuit is "potted" (as suggested by the dotted line surrounding such elements) or isolated from outside circuits which permits continuity monitoring of the detonator bridge circuits as well as isolation of the energy stored on the capacitor from the environment in which it is applied, which environment is typically hazardous. Particularly, Opto-Isolator designated moc 8100 and capacitor C1 are maintained within this isolation portion.

These circuit additions allow for increased monitoring of the entire system which include, at least, monitoring of wire continuity; relay status; switch status and capacitor testing.

The end result of the provided circuitry is to maintain an intrinsically safe device which demand actual voltage reversal to result in a true break-before-make device.

What is claimed is:

1. A hazard response device for initiating the dispensing of suppression material into a walled, monitored enclosure upon pressure change within the enclosure, indicative of an explosive condition within the enclosure the device including:

a) a pressure sensor mounting structure sealingly arranged on a wall of the enclusre communicating with the interior thereof, providing surfaces for mounting pressure sensor units;

b) at lease three pressure sensors mounted on selected surfaces of said structure, each sensor including a sensing member having one side thereof communicating with the interior of the enclosure, the other side of said sensing member open to atmospheric pressure;

c) a switch associated with said other side of each of said sensing members and positioned to be actuated by movement of said sensing members generating a signal upon movement;

d) suppression material delivery means associated and directed to deliver such material to with the interior of the housing; and, e) electrically powered circuitry responsive to the generated switch signal and controlling said material delivery means and actuating the same upon receipt of a signal from at least two of the three sensors.

2. The hazard response device as set forth in claim 1 wherein the signal generated by said switches is an electrical signal.

3. The hazard response device as set forth in claim 2 and the circuitry for actuating said suppression material delivery means including a true voltage reversal recognition portion, whereby spurious indicative or capacitive coupling is prevented from actuating said suppression material delivery means.

4. The hazard response device as set forth in claim 2 and the circuitry for actuating said suppression material delivery means includes a true voltage recognition portion, whereby an electrically generated signal from said switches must be recognized as passing through zero signal conditions to actuate said suppression material delivery means.

5. The hazard response device as set forth in claim 1 wherein each of said pressure sensors includes at least a pair of switches responsive to movement of said sensing member and each of said switches generating a signal at a preselected, different, amount of movement of said sensing member.

6. The hazard response device as set forth in claim 5 including means for compensating for positive pressures within a process enclosure which pressure may vary during operation, said compensation means including:

a) a first spring lever and switch combination responsive to movement of said sensing member and adjustable for operational signal generation at a first pressure level;

b) a second spring lever switch combination responsive to movement of said sensing member and adjustable for operational signal generation at a second process pressure level; and, c) electrical control means for selection of generated signals from said first and said second lever switch combinations operative upon command from logic circuitry responsive to operation or non-operation of process equipment.

7. The hazard response device as set forth in claim 1 and said sensor mounting structure including:

a) at least a pair of said surfaces arranged in parallel relation to each other;

b) a front surface arranged intermediate of said side surfaces;

c) one of said pressure sensors mounted respectively on each of said side surfaces;

d) the third of said pressure sensors mounted on said front surface; and e) each of said pressure sensors including a housing for retaining said sensing member and said switch.

8. The hazard response device as set forth in claim 7, wherein said surfaces are arranged in generally vertical relation on the enclosure and said front surface is positioned between said sides and is arranged to slope outwardly and downwardly from the enclosure.

9. The hazard response device as set forth in claim 1 and;

a) each of said pressure sensors providing a housing secured to said pressure sensor mounting structure; and, b) each of said housings providing an atmospheric venting opening therethrough whereby said sensing members exposed to enclosure pressure on one side thereof and atmospheric pressure on the other side thereof.

10. The hazard response device as set forth in claim 9 wherein;

a) each of said switches is provided with an actuating member; and, b) a lever/spring member arranged in association to said actuating member and said sensing member to transfer movement of said sensing member to said switch and actuate the same in response to movement of said sensing member due to an increase in pressure within the enclosure.

11. The hazard response device as set forth in claim 10 and;

a) lever/spring adjustment means having one end thereof inclose relation to said lever/spring; and, b) the other end of said adjustment means arranged exteriorly of said retaining housing whereby the actuation threshold of said switch may be adjusted.

12. The hazard response device as set forth in claim 10 and means for setting the actuation threshold of the system formed by said switches against positive pressure within the enclosure while said switches are in position on said pressure sensor mounting housing including:

a) means for joining said atmospheric venting openings of each of said sensor housing in a common, isolated linkage;

b) means for applying a vacuum pressure to said isolated linkage; and, c) means for measuring the vacuum applied to said isolated linkage, whereby the actuation threshold of each of said switches may be adjusted through said lever/spring adjustment means.

13. The hazard response device as set forth in claim 10 and means for setting the actuation threshold of the system formed by said switches against a pressure increase from negative pressure within the enclosure while said switches are in position on said pressure sensor mounting housing including:

a) means for joining said atmospheric venting openings of each of said sensor housings together in a common linkage;

b) means for connecting one end of said common linkage to a first check valve and to said pressure sensor counting housing; and, c) means for connecting the other end of said common linkage to a second check valve and through said second check valve to atmosphere whereby a vacuum pressure applied to said other end of said linkage will open said second check valve and close said first check valve whereby the vacuum in said pressure sensors operating against said sensing members represents the increase in pressure on the enclosure side of said sensing member and said lever/spring adjustment means may be adjusted in accordance therewith.

* * * * *